US010984942B2

(12) United States Patent
Kim et al.

(10) Patent No.: US 10,984,942 B2
(45) Date of Patent: Apr. 20, 2021

(54) COIL COMPONENT

(71) Applicant: SAMSUNG ELECTRO-MECHANICS CO., LTD., Suwon-Si (KR)

(72) Inventors: Jae Hun Kim, Suwon-Si (KR); Ji Hyung Jung, Suwon-Si (KR); Mi Geum Kim, Suwon-Si (KR); Ji Man Ryu, Suwon-Si (KR); Do Young Jung, Suwon-Si (KR); Joung Gul Ryu, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 232 days.

(21) Appl. No.: 16/174,214

(22) Filed: Oct. 29, 2018

(65) Prior Publication Data

US 2019/0287711 A1 Sep. 19, 2019

(30) Foreign Application Priority Data

Mar. 14, 2018 (KR) ..... 10-2018-0029971
May 28, 2018 (KR) ..... 10-2018-0060334

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/29* (2013.01); *H01F 41/042* (2013.01); *H01F 27/323* (2013.01); *H01F 2027/2809* (2013.01)

(58) Field of Classification Search
USPC ..... 336/200
See application file for complete search history.

(56) References Cited

U.S. PATENT DOCUMENTS 9,945,042 B2 4/2018 Cha et al.
10,388,447 B2 8/2019 Choi et al.
(Continued)

FOREIGN PATENT DOCUMENTS

CN 103377811 A 10/2013
CN 104934187 A 9/2015
(Continued)

OTHER PUBLICATIONS

Korean Office Action dated Jul. 4, 2019 issued in Korean Patent Application No. 10-2018-0060334 (with English translation).
(Continued)

*Primary Examiner* — Ronald Hinson
(74) *Attorney, Agent, or Firm* — Morgan, Lewis & Bockius LLP

(57) ABSTRACT

A coil component includes a body including a coil, and an external electrode disposed on an external surface of the body and connected to the coil, wherein the body includes a support member supporting the coil and including a through-hole and a via hole spaced apart from the through-hole, the coil includes a coil body and a lead portion connecting the coil body and the external electrode to each other, and a support thin film layer is interposed between one surface of the support member and one surface of the lead portion facing the one surface.

15 Claims, 2 Drawing Sheets

(51) Int. Cl.

| | |
|---|---|
| ***H01F 27/29*** | (2006.01) |
| ***H01F 41/04*** | (2006.01) |
| *H01F 27/32* | (2006.01) |

(56) References Cited

U.S. PATENT DOCUMENTS

| | | | | |
|---|---|---|---|---|
| 2008/0100409 | A1 | 5/2008 | Nishikawa et al. | |
| 2008/0142993 | A1 | 6/2008 | Ozawa et al. | |
| 2011/0007439 | A1 | 1/2011 | Asakawa et al. | |
| 2013/0222101 | A1* | 8/2013 | Ito | H01F 5/003 336/83 |
| 2013/0300529 | A1 | 11/2013 | Chang et al. | |
| 2014/0285305 | A1* | 9/2014 | Yoo | H01F 27/022 336/200 |
| 2015/0270053 | A1* | 9/2015 | Cha | C25D 5/10 336/192 |
| 2016/0163444 | A1* | 6/2016 | Choi | H01F 17/04 336/200 |
| 2016/0189840 | A1* | 6/2016 | Ahn | H01F 17/0013 336/192 |
| 2017/0178798 | A1 | 6/2017 | Yoon et al. | |
| 2018/0019051 | A1 | 1/2018 | Bong et al. | |
| 2020/0027650 | A1 | 1/2020 | Ryu et al. | |

FOREIGN PATENT DOCUMENTS

| | | | |
|---|---|---|---|
| CN | 105448503 | A | 3/2016 |
| CN | 110739117 | A | 1/2020 |
| JP | 2008-117851 | A | 5/2008 |
| KR | 10-1999-0066108 | A | 8/1999 |
| KR | 10-1436036 | A | 8/2014 |
| KR | 10-2015-0033343 | A | 4/2015 |
| KR | 10-2016-0081054 | A | 7/2016 |
| KR | 10-2017-0073174 | A | 6/2017 |
| KR | 10-2018-0007897 | A | 1/2018 |

OTHER PUBLICATIONS

Chinese Office Action dated Dec. 23, 2020 issued in Chinese Patent Application No. 201910090292.5 (with English translation).

* cited by examiner

COIL COMPONENT

CROSS-REFERENCE TO RELATED APPLICATION(S)

This application claims the benefit of priority to Korean Patent Application Nos. 10-2018-0029971 filed on Mar. 14, 2018 and 10-2018-0060334 filed on May 28, 2018, in the Korean Intellectual Property Office, the disclosure of which is incorporated herein by reference in its entirety.

TECHNICAL FIELD

The present disclosure relates to a coil component, and more particularly, to a thin film type power inductor.

BACKGROUND

In accordance with the development of information technology (IT), miniaturization and thinning of various electronic devices have been accelerated. Therefore, miniaturization and thinning of thin film type inductors used in such electronic devices have also been demanded. Although inductors have been miniaturized, there is a need to increase turns of coil patterns (to make the coil patterns fine), develop a material having high magnetic permeability, and increase heights of the coil patterns in order to accomplish the miniaturization of the inductors without causing loss of electrical characteristics of the inductors, such as an inductance, Rdc, and the like.

SUMMARY

An aspect of the present disclosure may provide a coil component of which Rdc characteristics are improved in a small size.

According to an aspect of the present disclosure, a coil component may include: a body including a coil, and an external electrode disposed on an external surface of the body and connected to the coil, wherein the body includes a support member supporting the coil and including a through-hole and a via hole spaced apart from the through-hole, the coil includes a coil body and a lead portion connecting the coil body and the external electrode to each other, and a support thin film layer is interposed between one surface of the support member and one surface of the lead portion facing the one surface.

The coil may include an upper coil having a coil body disposed on the one surface of the support member and a lower coil having a coil body disposed on the other surface of the support member.

The upper and lower coils may be connected to each other through a via filling the via hole of the support member.

A cross-sectional area of one surface of the support thin film layer in contact with the lead portion may be greater than that of one surface of the lead portion.

The lead portion may have a structure in which a plurality of strips are combined with each other.

The support member may have a thickness of 15 μm or more to 40 μm or less.

The support thin film layer may be exposed to the external surface of the body to be directly connected to the external electrode.

All of a surface on which the lead portion is in contact with the external electrode, a surface on which the support thin film layer is in contact with the external electrode, a surface on which the support member is in contact with the external electrode may be arranged on the same line.

A cross section of the support thin film layer may have a trapezoidal shape in which an edge in contact with the external electrode is longer than an edge opposing the edge in contact with the external electrode.

The body may have a hexahedral shape having first and second end surfaces opposing each other in a length direction, first and second side surfaces opposing each other in a width direction, and upper and lower surfaces opposing each other in a thickness direction.

The support thin film layer may be exposed to the first end surface.

A length of the support thin film layer extending from the first end surface toward an inside of the coil in the length direction may be smaller than a distance by which the coil body of the coil is spaced apart from the first end surface.

The coil may include a plurality of conductive layers.

Each of the plurality of conductive layers may include a seed layer in contact with the one surface of the support member.

The seed layer may include one or more of Mo, Nb, and Ni.

The seed layer included in the coil body may be indirect contact with the one surface of the support member, and the seed layer included in the lead portion may be in direct contact with one surface of the support thin film layer disposed on the one surface of the support member.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
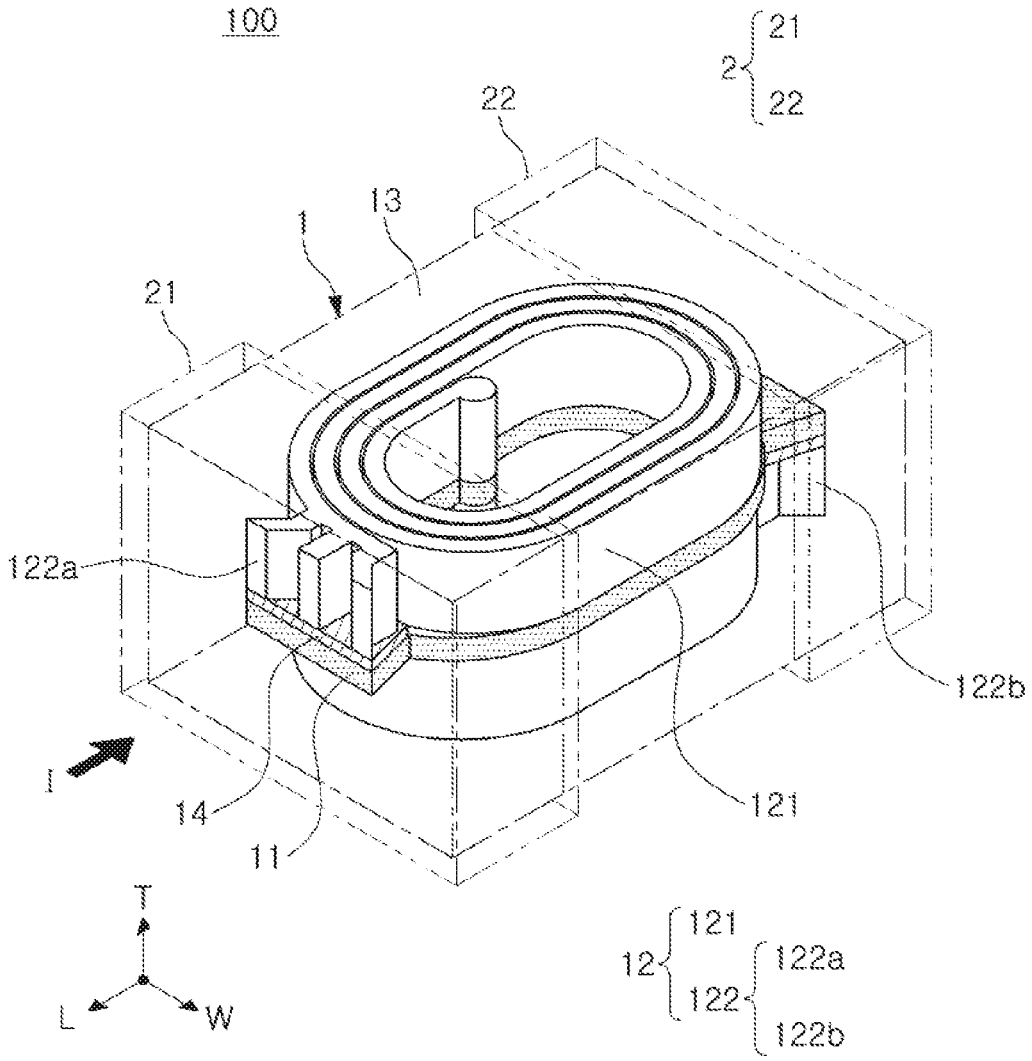
FIG. 1 is a schematic perspective view illustrating a coil component according to an exemplary embodiment in the present disclosure.

Hereinafter, exemplary embodiments of the present disclosure will be described in detail with reference to the accompanying drawings. In the accompanying drawings, shapes, sizes, and the like, of components may be exaggerated or stylized for clarity.

The present disclosure may, however, be exemplified in many different forms and should not be construed as being limited to the specific embodiments set forth herein. Rather these embodiments are provided so that this disclosure will be thorough and complete, and will fully convey the scope of the disclosure to those skilled in the art.

The term "an exemplary embodiment" used herein does not refer to the same exemplary embodiment, and is provided to emphasize a particular feature or characteristic different from that of another exemplary embodiment. However, exemplary embodiments provided herein are considered to be able to be implemented by being combined in whole or in part one with another. For example, one element described in a particular exemplary embodiment, even if it is not described in another exemplary embodiment, may be understood as a description related to another exemplary embodiment, unless an opposite or contradictory description is provided therein.

The meaning of a "connection" of a component to another component in the description includes an indirect connection through a third component as well as a direct connection between two components. In addition, "electrically connected" means the concept including a physical connection and a physical disconnection. It can be understood that when an element is referred to with "first" and "second", the element is not limited thereby. They may be used only for a purpose of distinguishing the element from the other elements, and may not limit the sequence or importance of the elements. In some cases, a first element may be referred to as a second element without departing from the scope of the claims set forth herein. Similarly, a second element may also be referred to as a first element.

Herein, an upper portion, a lower portion, an upper side, a lower side, an upper surface, a lower surface, and the like, are decided in the accompanying drawings. In addition, a vertical direction refers to the abovementioned upward and downward directions, and a horizontal direction refers to a direction perpendicular to the abovementioned upward and downward directions. In this case, a vertical cross section refers to a case taken along a plane in the vertical direction, and an example thereof may be a cross-sectional view illustrated in the drawings. In addition, a horizontal cross section refers to a case taken along a plane in the horizontal direction, and an example thereof may be a plan view illustrated in the drawings.

Terms used herein are used only in order to describe an exemplary embodiment rather than limiting the present disclosure. In this case, singular forms include plural forms unless interpreted otherwise in context.

Hereinafter, a coil component according to an exemplary embodiment in the present disclosure will be described. However, the present disclosure is not necessarily limited thereto.

Figure 2:
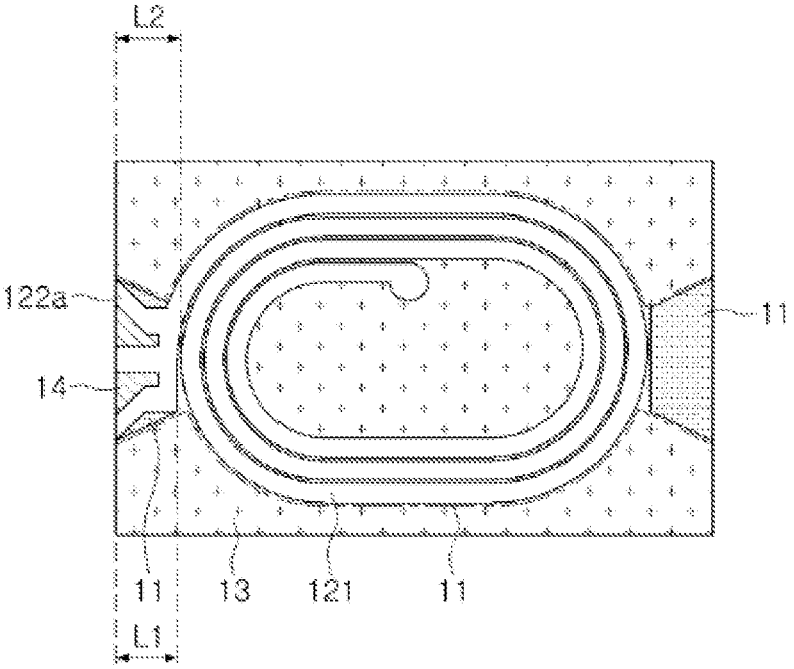
FIG. 2 is a plan view of FIG. 1 when viewed from the top.
Figure 3:
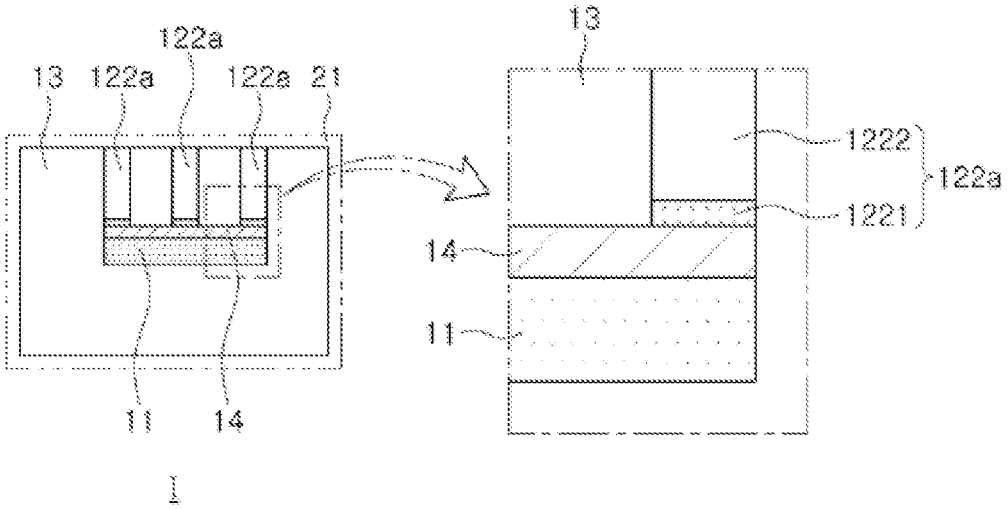
FIG. 3 is a plan view when viewed in direction I of FIG. 1.

FIG. 1 is a schematic perspective view illustrating a coil component 100 according to an exemplary embodiment in the present disclosure, FIG. 2 is a plan view of FIG. 1 when viewed from the top, and FIG. 3 is a plan view when viewed in direction I of FIG. 1.

Referring to FIGS. 1 through 3, the coil component 100 may include a body 1 and an external electrode 2.

The external electrode 2 may include a first external electrode 21 and a second external electrode 22 disposed on external surfaces of the body 1 and opposing each other in a length direction. The external electrode may have a shape in which it extends from one surface of the body to four surfaces adjacent to the one surface. However, the shape of the external electrode is not limited thereto, and may be variously modified by those skilled in the art, if necessary. For example, the external electrode may have an L shape or an I shape. The external electrode is connected to a lead portion of an internal coil, and thus needs to include a material having excellent electrical conductivity.

The body 1 may have first and second end surfaces opposing each other in a length direction L, first and second side surfaces opposing each other in a width direction W, and upper and lower surfaces opposing each other in a thickness direction T to substantially have a hexahedral shape.

The body 1 may include a support member 11 including a through-hole and a via hole. The support member may serve to mechanically support a coil 12 formed on the support member and allow the coil to be easily formed.

The through-hole of the support member 11 may be filled with an encapsulant 13 to be described below, and a magnetic permeability of the coil component may be increased due to the encapsulant filled in the through-hole. The via hole may be disposed to be spaced apart from the through-hole. The via hole may be a space in which a via connecting an upper coil and a lower coil to each other is to be formed.

The support member 11 may include a material having an insulation property, and may be a magnetic insulator having a magnetic property together with an insulation property. In detail, the support member may include a resin, a glass filler impregnated in the resin, and the like, and may be formed of an Ajinomoto build-up film (ABF), a photoimagable dielectric (PID) resin, or the like. The smaller the thickness of the support member, the more advantageous, and in order to support the coil and stably maintain a form of the coil at the time of forming the coil, the thickness of the support member may be, preferably, 5 μm or more to 60 μm or less, more preferably, 15 μm or more to 40 μm or less. When the thickness of the support member is smaller than 5 μm, the support member may not appropriately support the coil when a process of forming the coil is performed or it is likely that a rolling phenomenon will occur, and when the thickness of the support member is greater than 60 μm, it may be difficult to sufficiently increase a thickness of the coil due to a limited thickness of the coil component. Meanwhile, when thickness of the support member is 15 μm or more to 40 μm or less, the support member may stably support the coil while implementing a required thickness of the coil, such that occurrence of the rolling phenomenon at the time of forming the coil may be significantly reduced.

Next, the coil 12 may include a coil body 121 wound plural times and lead portions 122 connected to both end portions of the coil body, respectively. The lead portions 122 may include a first lead portion 122*a* connected to the first external electrode and a second lead portion 122*b* connected to the second external electrode.

A support thin film layer 14 interposed between the support member and the coil may be disposed below the lead portion 122 of the coil 12.

The support thin film layer may be a thin conductor layer serving to support the lead portion. The support thin film layer may include a metal, for example, Cu, but is not limited thereto. A thickness of the support thin film layer may be a thickness of 10 μm or more to 20 μm or less. This range of the thickness of the support thin film layer, i.e., 10 μm or more to 20 μm or less, enables the use of existing manufacturing facility without substantial modification and appropriately support the lead portion, as seen from a method of manufacturing a coil component described elsewhere herein.

A cross-sectional shape of the support thin film layer 14 may be a trapezoidal shape as illustrated in FIGS. 1 and 2. However, the support thin film layer 14 may have any cross-sectional shape such as a rectangular shape, a strip shape, or a cross-sectional shape including a curved line, as long as it may appropriately support the lead portion, in addition to the trapezoidal shape.

Since one end surface of the support thin film layer 14 is exposed to the external surface of the body, the one end surface may coincide with a diced surface, and may be directly connected to the external electrode. Resultantly, the lead portion of the coil may be appropriately supported by the support thin film layer 14, and an effect of increasing a contact area between the lead portion of the coil and the external electrode may be exhibited.

In addition, a length of the support thin film layer extending inward, that is, a length of the support thin film layer extending in the length direction may be appropriately selected to suit design parameters. However, when the support thin film layer extends up to a region in which the through-hole of the support member is formed, rigidity of the support thin film layer supporting the lead portion of the coil may be increased, but a negative effect of reducing an amount of the encapsulant filled in the through-hole may occur, which is not preferable. In this sense, a length L1 of the support thin film layer extending from the first end surface toward an inside of the coil in the length direction may be smaller than a distance L2 by which the coil body of the coil is spaced apart from the first end surface.

The lead portion 122 support by the support thin film layer may have the same cross-sectional shape as that of the support thin film layer, but may have a shape in which it includes a plurality of strips having a small line width, as illustrated in FIG. 1, in order to prevent over-plating occurring in the lead portion of the coil. When the lead portion of the coil includes the plurality of strips, a plating thickness deviation between the coil body and the lead portion of the coil may be reduced. The shape of the lead portion of the coil may be appropriately modified based on design parameters, if necessary, and when an entire area of a cross section of the lead portion is smaller than those of a cross section of the support thin film layer, the effect described above may be sufficiently implemented.

Referring to FIG. 3, end surfaces of the support member, the support thin film layer, and the coil, i.e., lead portion, that are sequentially stacked may be exposed to the first end surface of the body. All of the end surfaces exposed to the first end surface of the body may be a surface diced in a dicing process in order to individualize the coil component.

The lead portion 122*a* of the coil may be exposed, and as seen from the lead portion 122*a*, the coil may include a plurality of conductive layers.

Each of the plurality of conductive layers may include a seed layer and a plating layer disposed on the seed layer.

The lead portion 122*a* may include a seed layer 1221 and a plating layer 1222, and the seed layer included in the lead portion may be in direct contact with one surface of the support thin film layer 14 disposed on one surface of the support member. The seed layer may be formed of a conductive metal, and may include, for example, one or more of Mo, Nb, and Ni. A method appropriate for using such a metal, for example, a sputtering method may be used to form the seed layer.

Meanwhile, although not illustrated in detail, a seed layer included in the coil body may be in direct contact with one surface of the support member. The reason is that the support thin film layer does not extend up to the coil body, and the seed layer is thus disposed directly on the support member. Since the seed layer included in the coil body and the seed layer included in the lead portion of the coil are simultaneously formed by the same process using the same material, they may be considered to be components that are substantially the same as each other except for positions at which they are disposed.

Although not illustrated in detail, a method of manufacturing the coil component 100 may be briefly described.

First, any known substrate such as, for example, copper clad laminate (CCL), may be prepared. In instances where the substrate is a CCL, the substrate may have a total thickness of approximately 60 μm by including copper plating layers disposed on opposite surfaces of a central insulating layer, respectively, and having a thickness of approximately 20 μm. Since a CCL substrate may be used as it is as described above, an existing facility may be used as it is. In this case, in addition to the known CCL substrate, a substrate obtained by performing chemical copper plating at a thickness of approximately 2 μm or more to 35 μm or lesson opposite surfaces of an insulating resin having a thickness of approximately 15 μm to 40 μm and having a total thickness that may be used in an existing facility as it is may be used in the process described above.

After the CCL substrate described above is prepared, a frame including a support thin film layer may be prepared by applying a tenting method to the CCL substrate. The frame may be formed by patterning a copper plating layer coated on the CCL substrate. Portions of an insulating resin covered by the copper plating layer in the CCL substrate may be exposed through the patterning.

The frame may have a form in which a plurality of lattices are combined with each other, and the support thin film layer may extend inward from one edge of each of the plurality of lattices. In the frame, the plurality of lattices may be removed in a dicing process to be described below, and in a final coil component, only the support thin film layer connected to the lattice in the frame may remain.

Then, a seed layer may be formed on an upper surface of the frame and an upper surface of the exposed insulating layer. A method of forming the seed layer is not limited, and may be, for example, sputtering, chemical vapor deposition (CVD), physical vapor deposition (PVD), or the like. The seed layer may be a basic layer for forming the coil.

Then, a process of forming the coil may be performed on the basis of the seed layer. In this case, a process of stacking a dry film, patterning the dry film through exposure and development, and plating the coil may be used, but is not limited thereto. In the process of plating the coil, anisotropic plating and isotropic plating may be appropriately combined with each other, a plating layer having a large aspect ratio (AR) may be formed at a time by patterning an insulating film having a large AR. Then, a short-circuit between adjacent coil patterns needs to be prevented by removing the seed layer of portions on which the coil patterns are not formed in the seed layer generally coated on the upper surface of the frame and the upper surface of the exposed insulating layer.

A coil having a final thickness may be completed, magnetic sheets may be filled on upper and lower surfaces of the coil to form a laminate, and a dicing process may be applied to the laminate to individualize the laminate into the respective coil components. Only the support thin film layer in the frame may remain and other lattice shapes may be removed, through the dicing process.

Then, a finish process of forming the external electrode on the individualized coil component to complete a final coil component may be performed. In this case, although a detailed description is omitted, processes such as insulation of the body using an insulating material, polishing edges, exposure of the lead portions, and the like, may be appropriately performed by those skilled in the art.

A description for features overlapped with those of the coil component according to the exemplary embodiment in the present disclosure described above except for the above-mentioned description will be omitted.

As set forth above, according to the exemplary embodiment in the present disclosure, a coil component of which Rdc characteristics of a coil are improved by increasing a thickness of each of coil patterns at a limited thickness of the coil component may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil including a coil body and a lead portion connecting the coil body and the external electrode to each other, and a support member supporting the coil and including a through-hole, a support thin film layer being interposed between a first surface of the support member and a first surface of the lead portion facing the first surface of the support member; and an external electrode disposed on an external surface of the body and connected to the coil, wherein the coil body and the lead portion both comprise a seed layer, and wherein the seed layer of the lead portion contacts the first surface of support thin film layer and the seed layer of the coil body contacts the first surface of support member.

2. The coil component of claim 1, wherein an area of the first surface of the support thin film layer in contact with the lead portion is greater than that of the first surface of the lead portion.

3. The coil component of claim 1, wherein the lead portion has a structure in which a plurality of strips are combined with each other.

4. The coil component of claim 1, wherein the support member has a thickness in a range from 15 μm to 40 μm.

5. The coil component of claim 1, wherein the support thin film layer is exposed to the external surface of the body to be directly connected to the external electrode.

6. The coil component of claim 1, wherein all of a surface of the lead portion in contact with the external electrode, a surface of the support thin film layer in contact with the external electrode, and a surface of the support member in contact with the external electrode are coplanar.

7. The coil component of claim 1, wherein the support thin film layer has a trapezoidal shape in a plane along the support member such that an edge in contact with the external electrode is longer than an edge opposing the edge in contact with the external electrode.

8. The coil component of claim 1, wherein the coil includes a plurality of conductive layers.

9. The coil component of claim 1, wherein the seed layer includes one or more of Mo, Nb, and Ni.

10. The coil component of claim 1, wherein the support thin film layer comprises an electrically conducting material.

11. The coil component of claim 1, wherein the coil includes an upper coil having a coil body thereof disposed on the first surface of the support member and a lower coil having a coil body disposed thereof on a second surface of the support member opposite the first surface thereof.

12. The coil component of claim 11, wherein the support member includes a via hole spaced apart from the through-hole, and the upper and lower coils are connected to each other through a via filling the via hole of the support member.

13. The coil component of claim 1, wherein the body has a hexahedral shape having first and second end surfaces opposing each other in a length direction, first and second side surfaces opposing each other in a width direction, and upper and lower surfaces opposing each other in a thickness direction.

14. The coil component of claim 13, wherein the support thin film layer is exposed to the first end surface.

15. The coil component of claim 13, wherein a length of the support thin film layer extending from the first end surface toward an inside of the coil in the length direction is smaller than a distance by which the coil body of the coil is spaced apart from the first end surface.

* * * * *